United States Patent [19]

Amos

[11] 4,442,958

[45] Apr. 17, 1984

[54] CONTAINER FOR DISPENSING A VISCOUS LIQUID MEDIUM

[75] Inventor: Walter Amos, Wiesbaden, Fed. Rep. of Germany

[73] Assignee: Blendax-Werke R. Schneider GmbH & Co., Mainz, Fed. Rep. of Germany

[21] Appl. No.: 242,072

[22] Filed: Mar. 9, 1981

[30] Foreign Application Priority Data

Mar. 10, 1980 [AT] Austria ..... 1328/80

[51] Int. Cl.[3] ..... B65D 37/00; B65D 5/40

[52] U.S. Cl. ..... 222/213; 222/260; 222/320; 222/378; 222/514

[58] Field of Search ..... 222/209, 215, 260, 320, 222/321, 378, 206, 212, 372, 380, 381, 383, 402.1, 402.24, 382, 207, 400.5, 213, 514, 518, 525

[56] References Cited

U.S. PATENT DOCUMENTS

| | | | |
|---|---|---|---|
| 2,155,202 | 4/1939 | Parvis | 222/514 X |
| 2,596,592 | 5/1952 | Parker | 222/213 X |
| 2,898,007 | 8/1959 | Gassaway | 222/213 X |
| 3,088,636 | 5/1963 | Spatz | 222/213 |
| 3,396,874 | 8/1968 | Malone | 222/402.1 |
| 3,870,200 | 3/1975 | Spatz | 222/206 |
| 4,190,180 | 2/1980 | Bennett | 222/207 |
| 4,241,854 | 12/1980 | Bennett et al. | 222/207 |

*Primary Examiner*—Robert B. Reeves
*Assistant Examiner*—Russell D. Stormer
*Attorney, Agent, or Firm*—Jordan B. Bierman; Linda Bierman

[57] ABSTRACT

A container for holding a viscous liquid medium and from which the same may be selectively dispensed in a desired amount includes a rigid body having a deformable top portion and carrying a dispensing mouthpiece. The application of an inwardly-directed force to the mouthpiece deforms the container top portion and causes displacement of the mouthpiece partially into the container interior such that valve openings in the mouthpiece that are normally disposed sealingly within a valve body in the interior of the container are carried to a position remote from and clear of the valve body to clear the valve openings and permit a dispensing flow of liquid through the mouthpiece and thereby out of the container body.

2 Claims, 7 Drawing Figures

CONTAINER FOR DISPENSING A VISCOUS LIQUID MEDIUM

BACKGROUND OF THE INVENTION

The present invention generally relates to a container for a viscous medium and, more specifically, to such a container from which a controllable amount of the liquid may be selectively dispensed. The container of the invention is particularly well suited for use with appropriately viscous cosmetic compositions, such as toothpaste.

German DOS No. 3,611,644 discloses a container for viscous cosmetics—such as toothpaste—from which the same may be manually dispensed. The container is provided with an inwardly displaceable piston forming its bottom and secured by a pawl against relatively outward movement, and a compressable container portion formed of a flexible, elastic material such as a polyester elastomer and including a dispensing mouthpiece. A dispensing valve arranged within the container before the inlet cross-section of the mouthpiece is opened on an increase in interior container pressure and is formed of a plastic material shaped in a pot-like configuration. A circular flap comprising the pot bottom is normally urged against a projection to close the dispensing mouthpiece inlet. However, a suitable increase in the internal pressure of the container effected by compression of the flexible container portion causes the flap—which has a maximum diameter of approximately 10 mm—to move from its seat into the valve cross-section so as to open the mouthpiece inlet and enable an outward, dispensing flow of the contained viscous composition under the force of increased internal pressure.

The above-described container suffers from a variety of drawbacks. The required internal pressure increase, which is operatively effected by the exertion of pressure on the container mouthpiece, must be relatively great. Yet due to the elasticity of the flexible container portion and the operative configuration of the valving assembly, accurate control of the proportion of the contained liquid contents dispensed is difficult if at all possible. Moreover, unless the container is completely filled with the composition to be dispensed, the presence of air pockets or inclusions can seriously hamper reliable functioning of the dispensing container. Still further, manufacture and assembly of the various parts comprising the container—and particularly those forming the valving apparatus thereof—are relatively costly and complex and relatively stringent production tolerances must be observed.

It is accordingly the object of the invention to provide a container for dispensing a viscous liquid composition that overcomes the disadvantages and problems of the prior art. More particularly, it is an object to provide such a container that is readily operable to dispense a relatively controllable quantity of the contained liquid, that is reliable in continued use, and that may be readily manufactured and assembled of a minimum number of component parts at relatively low cost.

The present invention consists at least in part of the features of construction, combinations of elements, and arrangements of components which is exemplified in the construction hereinafter described and of which the scope is indicated by the appended claims.

BRIEF DESCRIPTION OF THE DRAWING

In the drawing, wherein similar reference characters denote similar elements throughout the several views.

DETAILED DESCRIPTION OF THE PREFERRED EMBODIMENT

The present invention relates to a container for holding a viscous liquid medium or composition and from which the liquid may be selectively dispensed. The dispensing container herein disclosed in accordance with the teachings of the invention is particularly notable for its structural simplicity, ease of manufacture, and convenience and reliability of operation.

Figure 1:
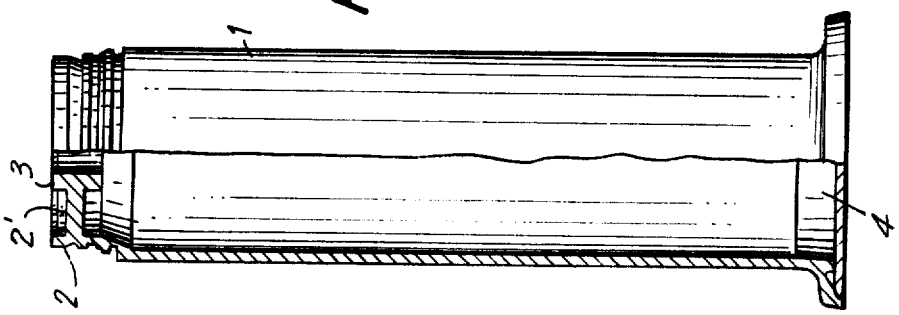
FIG. 1 is side view, partly in section, of the tubular body of a dispensing container constructed in accordance with the present invention.

Turning now to FIG. 1 of the drawing, a tubular body 1, which may be formed of a transparent or opaque plastic material, is substantially cylindrically configured of a rigid, continuous sidewall bounding a hollow interior. The lower-disposed end of body 1 is closed by a piston 4 arranged for upward or inward displacement along the body so as to gradually decrease the interior volumetric extent of the container. Piston 4 is prevented from outward movement otherwise effective to enlarge the container interior by the provision of such suitable structure as, for example, a known pawl, a spring ring, or appropriate groove structures. Although it is intended that piston 4 cooperates with the interior sidewall surface of body 1 to prevent the flow of liquid therebetween, a container bottom may be provided to further seal the lower end of body 1.

The upper-disposed end of the container body is open for communication with its hollow interior within which dispensable viscous liquid is contained. The open, upper end of body 1 may be provided with a diametrically-constricted rim portion 2. In the preferred embodiment shown in the drawing, rim portion 2 is ringed by a series of annular indentations to facilitate sealed retention thereon of a deformable container top 6 as will hereinafter be described. In any event, retention hubs 2' project inwardly from rim portion 2 and support an annular guide ring 3 which functions in cooperation with other elements of the apparatus as a valve body; this too will become clear as this description proceeds. Guide ring 3 is preferably centered on the longitudinal axis of tubular body 1.

An elastically deformable container top 6 is mounted sealingly atop body 1 to substantially close its open end. However, deformable top 6 includes an elevated neck portion peripherally bounding a central aperture through top 6 and communicating with the hollow interior of body 1. The resilient elasticity of container top 6 enables the same to be selectively deformable from its normal shape and position seen in FIG. 3A downwardly or inwardly to a dispensing position substantially in the direction of the hollow interior of the container body and seen in FIG. 3B; top 6 is thereafter resiliently returnable upwardly in the figures to its normal position.

Figure 4B:
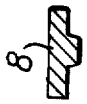
FIGS. 4A, 4B, and 4C are sectional side views of the individual components assemblable to form the upper container portion shown in FIGS. 3*a* and 3*b*.
Figure 4A:
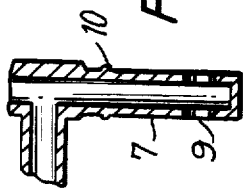
Figure 4C:
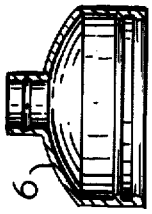

A dispensing mouthpiece 7 separately shown in FIG. 4*a* extends through the necked aperture in container top 6 and is fixedly secured or fastened thereto, as for example by the provision of webbed retentions or projections 10, for cooperative engagement with the neck of top 6 and to prevent relative sliding movement therebetween. Mouthpiece 7 is thus positionally secured so that one longitudinal end portion of the mouthpiece is disposed exteriorly of the container body; this exteriorly-disposed end includes an angled section having an open mouth communicating with a liquid transfer passage that extends within mouthpiece 7. An opposite longitudinal end portion of the mouthpiece is positioned within the hollow interior of body 1, and, more particularly, extends relatively movably through guide ring 3 thereof. At least one—and preferably several—valve openings 9 which communicate with the mouthpiece interior liquid transfer passage are so defined in that portion of the mouthpiece positioned within the container interior as to be normally disposed within guide ring 3. Thus, in the so-called normal position of deformable container top 6, valve openings 9 are disposed within the defines of guide ring 3. The relative sizing of mouthpiece 7 and of guide ring 3 are such that valve openings 9 are closed or sealed by the wall of ring 3 against liquid communication through the openings of liquid contained within tubular body 1 in said normal or nondispensing position of container top 6. This positional arrangement is best seen in FIG. 3A.

Selective deformation of container top 6 is most easily effected by the application of downwardly-directed pressure on mouthpiece 7. For this purpose, the mouthpiece is provided at its topmost portion with a push button 8 upon which a user's finger is readily accommodated for operative use of the dispensing container.

A protective cap 5 which may be designed to tightly seal the otherwise open mouth of mouthpiece 7 is arranged for releasable engagement about the upper portion of the inventive container for facilitated storage during periods of nonuse.

Figure 3A:
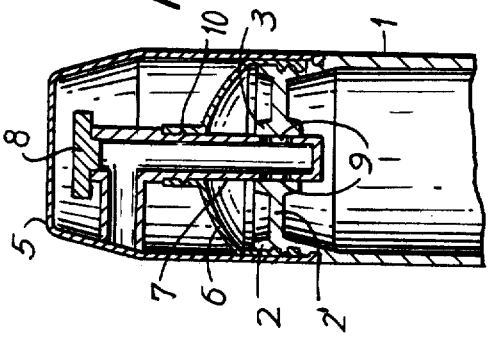
FIGS. 3A and 3B are sectional side views of the upper, dispensing portion of the container of the invention shown in the normal and the dispensing conditions, respectively.
Figure 3B:
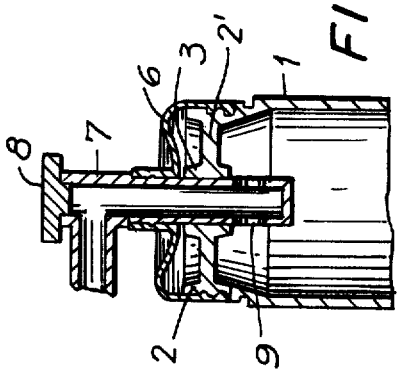
Figure 2:
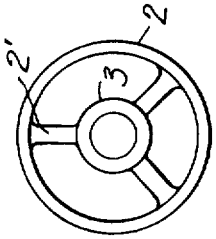
FIG. 2 is a top plan view of the container body of FIG. 1.

In the operation of the dispensing container according to the present invention, downwardly-directed pressure applied to push button 8 of mouthpiece 7 causes elastic deformation of container top 6 whereby the same moves from its normal, FIG. 3A position toward the dispensing position seen in FIG. 3B. Mouthpiece 7 is supportedly directed or guided in its downward movement by ring 3 through which the mouthpiece lower portion is relatively slidable. As mouthpiece 7 is inwardly displaced with respect to guide ring 3, valve openings 9 are correspondingly carried beyond the lower extent of ring 3—and eventually to the position shown in FIG. 3B in which openings 9 are located remote from ring 3—whereby the flow of liqid through openings 9 and out of container body 1 through mouthpiece 7 is permitted.

Those skilled in the art will recognize that the deformation of elastic container top 6 by the exertion of downwardly-directed pressure on mouthpiece 7 causes a pressure increase internally within container body 1. As valve openings 9 are carried by mouthpiece 7 into at least partial clearance of guide ring or valve body 3, the increased interior pressure forces the viscous liquid contained within body 1 upwardly through mouthpiece 7 and out of the container. As a consequence, it should be further recognized and understood that by manually controlling the degree to which mouthpiece 7 is depressed by the user, the amount or proportion of liquid dispensed is relatively accurately controllable. The dispensing of liquid will continue so long as increased interior container pressure is maintained; thus, the larger the increase in interior pressure as determined by the extent to which mouthpiece 7 is depressed, the greater the amount of liquid dispensed.

When the application of downward pressure to push button 8 is terminated and the increase in interior container pressure has been eliminated by ejection of an appropriate portion of the liquid contents, elastic container top 6 returns upwardly to resume its original shape and position seen in FIG. 3A. The partial vacuum or negative pressure thereby created within the container causes piston 4 to move upwardly into tubular body 1 and thereby correspondingly decrease the volumetric extent within which the viscous liquid is contained. Since piston 4 is constrained against outward or downward return movement, subsequent downward displacement of mouthpiece 7 for further dispensing of liquid will once more result in increased internal pressure in accordance with the preceding description. Moreover, the upward movement of piston 4 serves to maintain the interior volume of the container completely filled with the viscous liquid and thereby prevents the accumulation of air pockets that might interfere with efficient and reliable operation of the dispensing container.

Although the preferred embodiment of the dispensing container shown and constructed in accordance with the teachings of the invention is particularly suitable for use with liquid compositions having a paste-like consistency—such as toothpaste—any suitably viscous medium may be dispensed therefrom and no such limitation in either the concept or the constructural design of the present invention is contemplated.

Thus, a container suitable for selectively dispensing a viscous liquid medium has been disclosed. The preferred embodiment of the dispensing container shown in the drawing and described herein is particularly noteworthy for its efficient and reliable operation with the application of a relatively small force and its ability to dispense a selectively controllable quantity of the contained liquid. Moreover, the described container is formed of a minimum number of individual, component parts that are readily manufacturable and assemblable for ease of production.

While there has been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended thereto.

What is claimed is:

1. A container from which a viscous liquid contained therein is selectively dispensible, said container comprising:

a tubular body for containing a supply of liquid, said body having a hollow interior open at one end of the body;

a valve body disposed on said container body proximate the open end thereof;

a piston proximate an end of said body opposite its open end and arranged for displacement along said hollow interior toward said open end;

a resiliently deformable container top on said tubular body at said open end and substantially closing the same, said top including an aperture defined therethrough communicating with said hollow interior, said top being selectively deformable from a normal position to a dispensing position substantially in the direction of said hollow interior of the container body and thence resiliently returnable to said normal position; and an elongated dispensing mouthpiece fixedly secured to said top and extending through said aperture thereof, said mouthpiece including an open mouth disposed exteriorly of said container body and at least a valve opening disposed within the hollow interior of said body, and said mouthpiece further including a passage for liquid communication extending between said open mouth and said valve opening of the mouthpiece;

said valve opening being so defined in the mouthpiece that in said normal position of the container top the valve opening is closed by said valve body whereas deformation of the top to its dispensing position correspondingly carries the mouthpiece to move the valve opening therein to a position remote from said valve body to enable liquid contained in the tubular body to dispensingly flow through said valve opening and out of said container through the open mouth under the increased interior container pressure created by the inwardly directed deformation of said container top from its normal to its dispensing condition;

said tubular body having a substantially continuous sidewall bounding the hollow interior of said body, and said valve body comprising an annular ring supported in radially inwardly spaced relation from said sidewall proximate said container open end and through which said mouthpiece relatively movably extends such that said valve opening of the mouthpiece is disposed within said annular ring in said normal position of the container top to close the valve opening and prevent the flow of liquid contained in the tubular body dispensingly through the mouthpiece, while in said dispensing position of the container top the mouthpiece is relatively moved with respect to said annular ring so that the valve opening is correspondingly carried to a position remote from the annular ring to permit the flow of liquid through the opening and out of said container.

2. A container in accordance with claim 1, said valve body further comprising a plurality of hubs extending radially outward of said annular ring to connect said ring to the sidewall and thereby support said ring in radially inwardly spaced relation from said sidewall.

* * * * *